US005694898A

United States Patent [19]

Pontoppidan et al.

[11] Patent Number: 5,694,898

[45] Date of Patent: Dec. 9, 1997

[54] INJECTOR WITH FUEL-DISPERSING SKIRT

[75] Inventors: Michaël Pontoppidan, Rueil-Malmaison; Bruno Covin, Boulogne-Billancourt; Jean Christopher Lucas, Cergy; Christophe Preterre, Paris, all of France

[73] Assignee: Magnetic Marelli France, Nantarre Cedex, France

[21] Appl. No.: 563,081

[22] Filed: Nov. 27, 1995

[30] Foreign Application Priority Data

Dec. 1, 1994 [FR] France ..... 94 14457

[51] Int. Cl.[6] ..... F02M 55/02; B05B 1/26

[52] U.S. Cl. ..... 123/470; 239/499; 123/531

[58] Field of Search ..... 123/470, 471, 123/472, 432, 445, 531, 533; 239/499, 590, 585.1, 585.3

[56] References Cited

U.S. PATENT DOCUMENTS

| | | | |
|---|---|---|---|
| 4,243,003 | 1/1981 | Knapp | 123/470 |
| 4,289,104 | 9/1981 | Takada et al. | 123/471 |
| 4,347,822 | 9/1982 | Casey | 123/470 |
| 4,434,766 | 3/1984 | Matsuoka et al. | 123/531 |
| 4,527,744 | 7/1985 | Hafner et al. | 239/499 |
| 4,532,906 | 8/1985 | Hoppel | 239/585.1 |
| 4,585,174 | 4/1986 | Knapp | 239/585.1 |
| 4,650,122 | 3/1987 | Kienzle et al. | 239/585.1 |
| 4,699,110 | 10/1987 | Iwano et al. | 123/472 |
| 5,054,456 | 10/1991 | Rush, II et al. | 123/470 |
| 5,150,691 | 9/1992 | Imajo et al. | 123/472 |
| 5,156,133 | 10/1992 | Sugimoto et al. | 123/531 |
| 5,167,211 | 12/1992 | Fukuma et al. | 123/470 |
| 5,197,672 | 3/1993 | Grytz . | |
| 5,207,383 | 5/1993 | Hans et al. | 123/531 |
| 5,211,682 | 5/1993 | Kadowaki et al. | 123/531 |
| 5,215,063 | 6/1993 | Yeh | 123/531 |
| 5,224,458 | 7/1993 | Okada et al. | 123/531 |
| 5,241,938 | 9/1993 | Takagi et al. | 123/472 |
| 5,323,966 | 6/1994 | Buccholz . | |
| 5,329,905 | 7/1994 | Kawaguchi et al. | 123/472 |
| 5,340,032 | 8/1994 | Stegmaier et al. | 239/585.1 |

FOREIGN PATENT DOCUMENTS

| | | |
|---|---|---|
| 0 302 637 | 7/1988 | European Pat. Off. . |
| 94 08646 | 1/1996 | France . |
| 06093941 | 4/1994 | Japan . |

*Primary Examiner*—Thomas N. Moulis
*Attorney, Agent, or Firm*—Henderson & Sturm

[57] ABSTRACT

The injector comprises a body (1) with a tip (2) exhibiting at least one calibrated outlet hole for jets of fuel as well as a skirt (25) for dispersing the fuel received in the form of jets, the skirt (25) being tubular and extending the body (1) to which it is fixed by its upstream part (14), and its downstream part (26) is formed, at least toward the downstream end, by at least one lateral wall thinned to a bevel (28) of thickness decreasing toward the downstream end as far as its downstream free edge in the form of a thinned blade (29). For preference, a concave notch turned toward the downstream end is formed in the free edge of each bevel, and each jet (J1, J2) of fuel from the two-hole injector strikes a region (30) on the internal face of a lateral wall of the skirt.

Application to injectors, particularly multi-hole injectors, for automobile engines.

19 Claims, 5 Drawing Sheets

INJECTOR WITH FUEL-DISPERSING SKIRT

CROSS-REFERENCE TO RELATED APPLICATION

Not applicable

STATEMENT REGARDING FEDERALLY SPONSORED RESEARCH OR DEVELOPMENT

Not applicable

BACKGROUND OF THE INVENTION

1. Field of the Invention

The invention relates to a fuel-injector of any type delivering at least one jet of fuel, and relates more particularly to an injector of the so-called "multi-hole" type and more specifically of the "two-hole" type for supplying an internal combustion engine, particularly one having at least two inlet valves per combustion chamber of the engine and with injection of fuel selectively into one or each of two air intake ports per combustion chamber.

The invention therefore relates to field of fuel injectors for engines, particularly of automobiles, which are equipped with an installation for supplying fuel by injection, especially of the so-called "multipoint" type, that is to say comprising, for each combustion chamber, at least one preferably electrically controlled injector which emerges in the air intake manifold close to a corresponding inlet valve, and the injector of the invention is advantageously applied to equipping fuel-injected engines having at least two air intake ports per combustion chamber and possibly having at least two inlet valves per combustion chamber.

2. Description of Related Art

In these engines, to obtain the various conditions necessary for combustion to take place correctly, and especially to control the degree of homogeneity of the air/fuel mixture in the combustion chambers and alter the acoustic tuning of the intake circuit, giving the desired torque performance, it has already been proposed to supply each combustion chamber using several air intake ports, ideally equal in number to the number of inlet valves of the combustion chamber, so as to alter the supplying of the combustion chamber by controlling the opening of one or more of the ports emerging upstream of the inlet valves of this chamber.

To this end, it has already been proposed to use, for each combustion chamber having at least two inlet valves, a multi-hole and particularly a two-hole injector which, at low idle and at low and medium engine loads, operates as a single-hole injector, injecting one jet of fuel into a first air intake port and directed toward a first inlet valve then, at high engine loads, which operates as a two-hole injector, that is to say which delivers, in addition to the first jet, a second jet of fuel injected into the second air intake port and directed toward a second inlet valve.

Such a two-hole injector makes it possible to govern, to a certain extent, the conditions in which the air/fuel mixture is formed in the corresponding combustion chamber, through the more or less complete closure of one of the intake ports to this chamber, carried out with a restriction member situated downstream of the main throttle valve regulating the air supply to the intake manifold.

However, the quality of the air/fuel mixture supply to a combustion chamber, together with the quality of this mixture remain dependent on the shapes and dimensions of the portions of the air intake port or ports which extend between the mouth of the injector housing in this or these ports and the seat or seats of the corresponding inlet valve or valves. In particular, the length of the intake port or ports between substantially the tip of the injector and the inlet valve or valves, as well as the shape of the connection between the injector housing and the air intake port or ports are deciding factors.

BRIEF SUMMARY OF THE INVENTION

The object of the invention is to overcome these drawbacks, and in particular to propose a fuel injector which gives better preparation of the air/fuel mixture than that which is obtained with known injectors.

Another object of the invention is to propose a fuel injector, particularly of the multi-hole type, which is better suited to the various practical requirements than those which are known, especially in so far as it can be mounted on any intake manifold or, possibly, any cylinder head of known conventional structure, without any particularly fine prior adaptation of the injector to suit the manifold or the cylinder head.

In particular, the object of the invention is to propose a fuel injector of structure which is advantageous when the structure and geometry of the cylinder head and/or of the air intake tract are such that the distance between the tip of the injector and the corresponding injection valve or valves is relatively long.

To this end, the fuel injector according to the invention, particularly of the so-called multi-hole type, comprising a body equipped with a tip, intended to be turned toward at least one air port, and exhibiting at least one calibrated outlet hole for at least one jet of fuel oriented substantially toward the corresponding air port or ports, is characterized in that it also comprises a skirt for dispersing the fuel which it receives from each calibrated hole and which it transfers into the said air port or ports, the skirt having a tubular overall structure substantially extending the body and exhibiting an upstream part secured to the body and surrounding the injector tip and the calibrated hole or holes and a downstream part delimiting at least one outlet orifice through which at least one fuel passage formed in the skirt emerges toward the or one of the air ports, the skirt being formed, at least in its downstream part by at least one lateral wall progressively thinned to a bevel, with thickness decreasing from upstream to downstream as far as its downstream free edge, into a thinned blade.

The bevel or bevels may be made on the internal face or on the external face of the downstream part of the skirt, used according to the invention as an active diffuser for the fuel coming from the calibrated hole or holes of the injector tip.

Good preparation of the air/fuel mixture is thus provided, through the fact that the free edge or edges in the form of thinned blades of the wall or walls of the skirt at its downstream end allow films of fuel coming from the edge of the bevel or bevels to be torn away by the energy contained in the air flow in the intake port or ports adjacent to this downstream end of the skirt.

Advantageously, however, even better preparation of the mixture is provided if, in addition, a concave notch, with concavity turned toward the downstream end, is formed in the downstream free edge in the form of a thinned blade of each bevel, because such a notch increases the length of the trailing edge and thus the tearing away and consequently the atomization, of the liquid films of fuel which may run down the internal face of the downstream part of the skirt.

When the structure and the geometry of the cylinder head and/or of the air intake tract are such that the distance between the tip of the injector and the corresponding inlet valve or valves is relatively long, the injector of the invention is advantageously such that at least one lateral wall of its dispersing skirt exhibits, on its internal face, at least one region intended to be struck by at least one jet of fuel leaving at least one calibrated hole.

The injector skirt thus produced, obtained by adapting its geometry, and in particular its length, to suit the tip of the injector, and especially the angle of separation or of divergence between the jets of fuel leaving the calibrated holes of the tip in the case of a multi-hole injector, gives a post-atomization effect, using at least one trailing edge of the thinned blade at the downstream edge of its lateral wall or walls as a post-diffuser. This or these post-atomization trailing edge or edges is or are thus brought closer to the inlet valves or valves and, in the case of a multi-hole injector, an angular recentering of the jets of fuel leaving the injector tip is obtained through them striking against the lateral wall or walls. The advantage of this structure is to minimize the formation of liquid films of fuel on the wall in the extension of the intake port in the cylinder head close to the inlet valve seat or seats and to afford relative insensitivity with respect to the angle of separation between the jets of fuel leaving the tip of the injector.

In contrast, when the distance between the injector tip and the corresponding inlet valve or valves is not too long, it may be advantageous for the jet or jets of fuel leaving the calibrated hole or holes to be injected into a central bore which diverges toward the downstream end of the dispersing skirt, which skirt may be relatively short and/or interact with a multi-hole injector tip for which the angle of separation between the jets is relatively small, so that the skirt may allow the developed jet or jets of fuel to pass freely through space between its lateral walls as far as the outlet orifice of the corresponding fuel passage which emerges in the or one respectively of the air intake ports, so as to profit from the post-atomization effect of the trailing edge or edges of the thinned blade or blades of the skirt only for that part of the fuel which emanates from the injector during the phases in which the latter is opening or closing, because during these transient phases, the precision of the orientation of the jet or jets is not as good as during the phase in which the injector is fully open when the jet or jets are developed, which may lead to the formation of the deposit of a liquid film on the internal face of the walls of the skirt, which is why it is important in accordance with the invention for these to have the profile of a thinned blade.

In order to produce an injector with a post-atomization skirt, it is advantageous for the jet or jets of fuel leaving the calibrated hole or holes to be injected into a cylindro-conical central bore of the skirt, at the downstream end of which skirt the central bore emerges via a divergent portion.

In general, the bevel or bevels of the lateral wall or walls of the skirt, at least in its downstream end part, may delimit (between them) a passage of constant transverse section or, for preference, a passage which diverges from upstream to downstream, but under no circumstance should this passage converge toward the downstream end, in order to obtain the desired correct diffusion of fuel.

In a simple embodiment, the skirt has a cylindrical external overall shape, preferably of circular section, and exhibits an axisymmetric central bore, in which case at least the downstream end part of this bore may be delimited by a single annular bevel.

The injector with fuel diffusing skirt according to the invention may be a multi-hole injector with purely hydraulic atomization, provided for by a mechanical device, and of any known type.

However, it is also possible for the injector with diffusing skirt of the invention to be an injector with air-assisted atomization, and especially with limited air flow, as described for example in French Patent Application No. 94 08646 now U.S. Pat. No. 5,520,159 of the Applicant Company and to which reference will be made for further information on the structure and operation of the injector.

In the latter case, the injector advantageously comprises a pneumatic atomization cap arranged in the skirt substantially even with the injector tip and delimiting around two jets of fuel leaving two calibrated holes, a substantially annular duct supplied with air for assisting with atomization substantially at atmospheric pressure, the cap exhibiting a plurality of orifices for the passage of air from the duct toward the jets of fuel, the air-passage orifices having axes substantially transversal to the jets of fuel and being distributed over the cap so that when each calibrated hole is freed, and for low pressure gradients at the air-passage orifices, at high engine loads, two jets of fuel leaving the calibrated holes are diffused by the skirt each toward one respectively of the air intake ports, whereas for high pressure gradients, at low idle and low and medium engine loads, one of the jets of fuel leaving the calibrated holes preferably being deflected by the air passing through the orifices of the cap toward the other jet of fuel with which it mixes into a single mist of fuel atomized pneumatically in the skirt. In such an injector, it will be understood that the skirt for dispersing the fuel fully performs its functions when the atomization is hydraulic, when the pneumatic assistance is ineffective, and conversely, the skirt of the injector does not perform or performs only partially, its function of dispersing the fuel and, optionally, its function of post-atomization, when the pneumatic assistance is effective.

Other advantages and features of the invention will emerge from the description given hereinbelow, with no implied limitation, of embodiments relating to fuel injectors with air assistance and dispersing skirt, described with reference to the appended drawings in which:

DETAILED DESCRIPTION OF THE INVENTION

Figure 1:
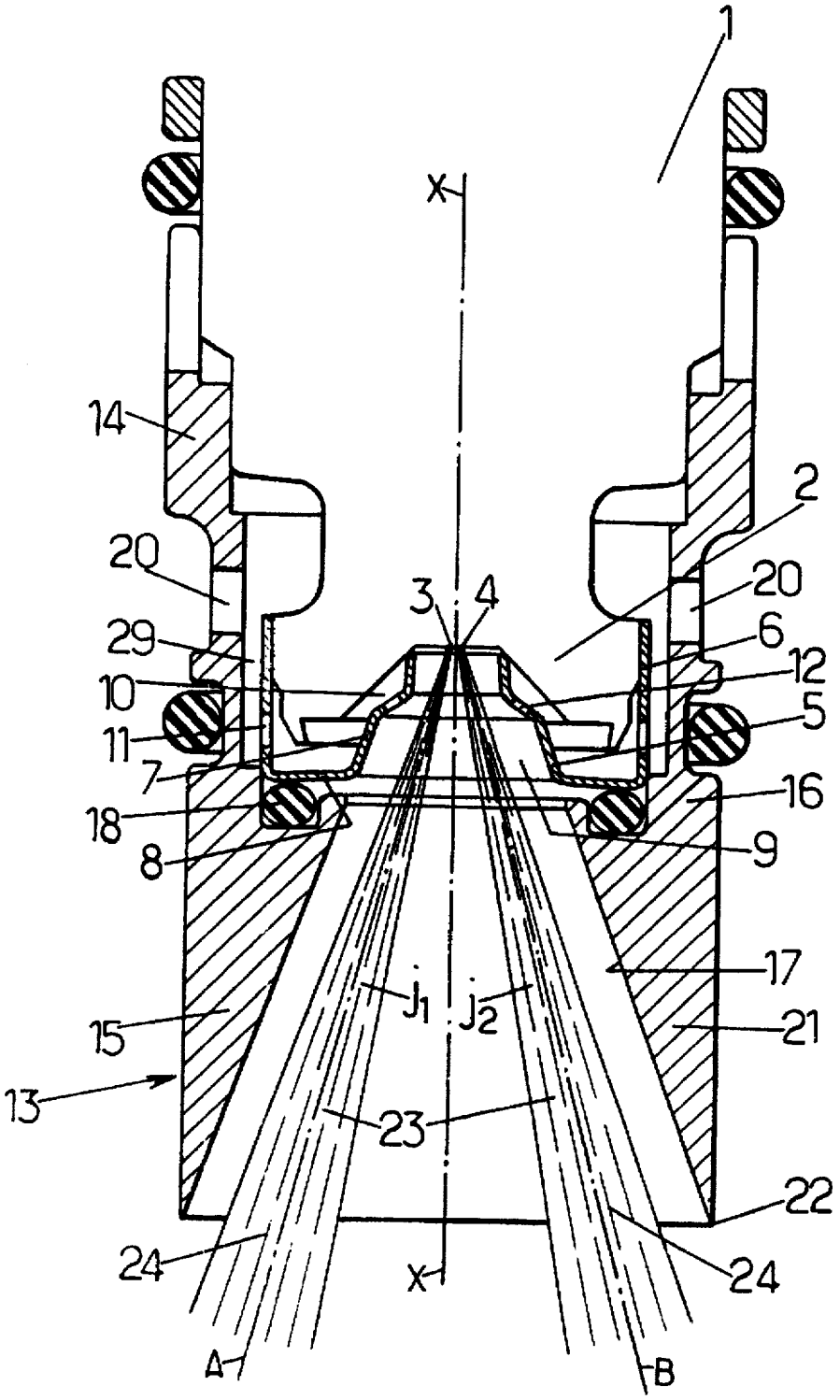
FIG. 1 is a diagrammatic view in diametral section of a modifiable two-hole injector with air assistance and short skirt, without post-diffusion of the jets developed.

The two-hole injector partially represented in FIG. 1 comprises a body, the silhouette of which is shown as 1, which is essentially cylindrical and of circular section, with axis X—X, and in which the end intended to be turned toward the two air intake ports to be supplied with fuel is equipped with an injector tip 2 which exhibits two calibrated outlet holes 3 and 4 for jets J1 and J2 of fuel of axes A and B which diverge with respect to one another and are oriented toward a fuel-dispersing skirt described hereinbelow and with which the injector is equipped, and toward the outside of the injector, substantially toward the air ports, as represented in FIG. 1. The holes 3 and 4 and the axes A and B are substantially symmetric with respect to the axis X—X and the axes A and B are substantially contained in one same diametral or mid-plane passing through X—X.

In a well known fashion, the holes 3 and 4 are normally closed by at least one shutter element, returned to a closed position by elastic return means, against which the shutter element or elements is or are moved away from each corresponding hole, to supply them with fuel under pressure in order to deliver at least one jet of fuel, by operating at least one actuator housed in the body 1 with the shutter element or elements and elastic return means.

The actuator may be pneumatically operated or hydraulically operated and include moving parts driving the shutter element or elements, but in general there are at least one electromagnet with at least one operating winding and at least one core plunger secured in terms of axial translation to the shutter element or elements thus separated from the hole or holes 3 and 4 by electrically powering the operating winding or windings to squirt out the two jets J1 and J2 of fuel.

In the absence of any pneumatic atomization mode, these jets are relatively fine, each having a small divergence, and substantially centered in the mid-plane containing the axes X—X, A and B, owing to the fact that a calibrating pellet (not represented) mounted in the tip 2 and in which the holes 3 and 4 are pierced, also constitutes an orifice plate for the hydraulic atomization of the fuel into the two jets J1 and J2.

In addition, like for an injector with limited flow rate air-assisted atomization, of the type known from French Patent Application No. 94 08646, now U.S. Pat. No. 5,520157 the description of which is incorporated into the present application by way of reference, the injector is equipped with a cap 5 for atomization using air, of annular overall shape, which is mounted by its peripheral cylindrical ring 6 around the tip 2 and which exhibits a central hollow shaft 7, of cylindro-conical shape, engaged inside the frustoconical recess in the face of the tip 2 on the opposite side from the body 1, being pressed via its free upper end against the tip 2, around the calibrated holes 3 and 4. The cap 5 also comprises a radial thin disk 8 (with respect to the axis X—X) connecting the hollow shaft 7 to the peripheral ring 6 pressed against the periphery of the tip 2, so that the cap 5 delimits with the tip 2 on the one hand, a region 9 for mixing and pneumatic assistance with atomization, delimited inside the hollow shaft 7, and in which the two calibrated outlet holes 3 and 4 for the jets J1 and J2 of fuel emerge and, on the other hand, a peripheral annular duct 10 which is supplied with air substantially at atmospheric pressure by holes 11 in the ring 6. The air for pneumatically assisting with atomization reaches the duct 10, passing into the fuel-diffusing skirt described hereinbelow and into a pipe which connects it to an air intake situated between the outlet of the engine air filter and the throttle valve body which regulates the main air supply for the engine. This air which has reached the duct 10 is introduced into the mixing and atomization region 9 in the form of jets of air, to provide for correct preparation of the air/fuel mixture in the jets J1 and J2, passing through defined air-passage orifices 12 made with suitable dimensions in the conical part of the central hollow shaft 7 of the cap 5 with a specific distribution and a specific orientation, which are described hereinbelow.

The air-passage orifices 12 of the cap 5 are, for example, distributed symmetrically with respect to the diametral and mid-plane containing the axes A and B of the holes 3 and 4 and the axis X—X of the injector (plane of FIG. 1) and, at the same time, these orifices 12 are asymmetric with respect to a second diametral plane perpendicular to the aforementioned one. The axes of these orifices 12 are inclined and converge toward one another and toward the inside of the atomization region 9, and the axis of each orifice 12 is slightly inclined from upstream to downstream with respect to the longitudinal axis X—X of the injector, the jets of air passing through these orifices 12 being substantially transversal to the jets J1 and J2 of the fuel. The specific orientation and specific distribution of the air-passage orifices 12 have the effect that at high engine loads, therefore when the air intake throttle valve is wide open, the pressure gradient applied across the orifices 12, between the duct 10 substantially at atmospheric pressure and the region 9, is a low gradient, so that the jets of air passing through the orifices 12 neither disturb nor modify the orientation of the jets J1 and J2 leaving the calibrated holes 3 and 4.

In contrast, when the engine is operating at low or medium load, or at low idle, the air intake throttle valve is partly open, the depression at the engine intake is great, and the gradient applied across the air-passage orifices 12 is great. The jets of air passing through these orifices 12 are therefore powerful enough, bearing in mind the arrangement and orientation of these orifices 12, to deflect the jet J1 of fuel, the atomization of which is improved by the jets of air, toward the jet J2 so as to mix the jets and combine them into a single mist of fuel which has been well atomized by the pneumatic assistance, and which is directed, through the skirt described hereinbelow, toward the only one of the two air intake ports which is to be supplied in this operating mode. In this configuration, the two-hole injector operates like a single-hole injector. This deflection of one of the two jets of atomized fuel toward the other results from the asymmetric structure given to the means providing for the diffusion of the air for pneumatic assistance with atomization by the cap 5. The switching from one to the other of the two operating configurations, as a two-hole injector and as a one-hole injector, takes place by automatic adaptation for a pneumatic gradient threshold for which the number, size, distribution, and orientation of the air passage orifices 12 have been determined.

Thus, the air reaching the region 9 is effective for improving atomization of the fuel at low or medium loads, at all speeds and at low idle. Excellent atomization is provided for in the modes of operation at low load such as during start-up or deceleration at high speed.

The injector also comprises a fuel-dispersing skirt 13 of cylindrical external overall shape of circular section, and of tubular structure, the upstream part 14 of which delimits an axisymmetric internal housing of widened section allowing the skirt 13 to be mounted and fixed around the body 1 and the tip 2 by any suitable and known mechanical means (screwing or crimping for example).

The upstream part 14 of the skirt 13 connects to its downstream part 15 in the region of an internal radial shoulder 16 surrounding the entry to a central bore 17 of the downstream part 15 and exhibiting an annular groove housing an elastically deformable O-ring seal 18 applied against the radial thin disk 8 of the cap 5, the external ring 6 of which is held against the periphery of the tip 2 by internal ribs 19 at the upstream part 14 of the skirt 13, between the shoulder 16 and the radial holes 20 pierced in this upstream part 14 for supplying the pneumatic assistance air substantially at atmospheric pressure passing between the ribs 19 as far as the holes 11 in the external ring 6 of the cap 5.

Thus, the skirt 13 supplies the cap 5 with air for assisting with atomization.

The central bore 17 of the downstream part 15 of the skirt 13, mounted substantially coaxially about the axis X—X on the tip 2 and the body 1 of the injector, is a frustoconical coaxial bore diverging toward the downstream end and such that the lateral wall of this part 15 of the skirt 13 is progressively thinned to a bevel 21 of thickness decreasing from upstream to downstream as far as its downstream free edge forming the trailing edge 22 in the form of a thinned blade.

In this example, owing to the circular section cylindrical shape of the skirt 13, the downstream end part of the latter is formed by a single annular bevel 21 diverging toward the downstream end, but in a variation, the downstream part 15 of the skirt 13 may be of polygonal section and formed of opposed lateral walls each of which is progressively thinned to a bevel of thickness decreasing toward the downstream end as far as a downstream trailing edge in the form of a thinned blade.

Thus, inside the single annular bevel 21, or between the bevels of opposed lateral walls, there are delimited two fuel passages 23, communicating with one another in the bore 17 and each opening out via an outlet orifice 24 into one respectively of the air intake ports supplying one and the same combustion chamber of the engine.

The downstream part 15 of the skirt 13 is short enough, bearing in mind the angle of separation of the jets J1 and J2 developed, for these jets to pass freely, as represented in FIG. 1, through the space delimited by the divergent bore 17, and therefore into the fuel passages 23 emerging at 24 in the air intake ports. By virtue of the bevel 21 with a downstream free edge in the form of a thin blade 22 forming a trailing edge, the liquid films of fuel supplied during the transient phases of the injector, and running along the internal walls of the downstream part 15 of the skirt 13, are torn away by the flow of the air in the intake ports, and possibly around the downstream end part of the skirt 13, which may project into these ports.

Good diffusion of all the fuel in the intake air is thus provided for by the injector with skirt 13, when the injector is in the purely hydraulic atomization configuration, that is to say without pneumatic assistance with atomization.

The short skirt 13 of the injector of FIG. 1 may be particularly advantageous when the distance between the tip 2 of the injector and the inlet valves of the combustion chamber to be supplied is not too great, bearing in mind the divergence of the jets J1 and J2.

When this distance is great, an injector with a long skirt may be advantageously be used, for example according to one of the variations of FIGS. 2 to 8, which can be distinguished from the injector of FIG. 1 only through the shape and length of the downstream part of their skirt, so that the same numerical references are retained for denoting the same elements.

Figure 2:
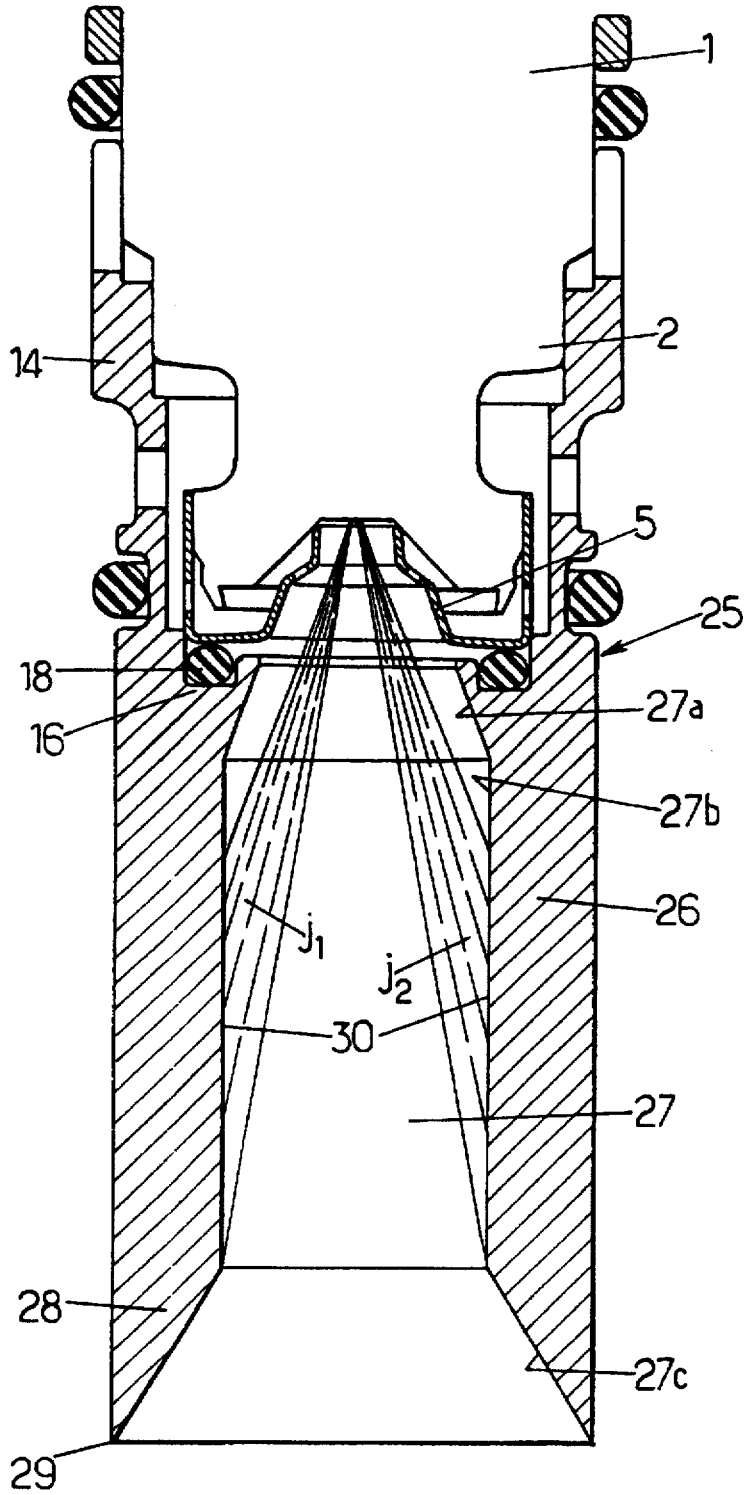
FIG. 2 is a view similar to FIG. 1 of a similar injector with a long skirt forming a post-diffuser.

The modifiable two-hole injector with air assistance of FIG. 2 has a long skirt 25, the downstream part 26 of which exhibits a central bore 27 of cylindro-conical shape, and formed more specifically of a frustoconical upstream portion **27*a* diverging from upstream to downstream, of a cylindrical intermediate portion 27*b*, preferably of circular section, extending over most of the length of the downstream part 26 of the skirt 25, and a downstream portion 27*c* also of frustoconical shape and diverging from upstream to downstream. This downstream portion 27*c* of the bore 27 constitutes the internal face of a annular bevel 28, constituting the downstream end of the downstream part 26 of the skirt 25, and terminating at its downstream free edge 29** in a thinned blade forming a trailing edge.

The length of the downstream part 26 of the skirt 25 and in particular the axial dimension of its bore portions **27*a* and 27*b*, is matched to suit the rest of the injector, and in particular the calibrated holes of its tip 2 so that each of the two divergent jets J1 and J2 of fuel leaving the tip 2 strikes a region 30 situated upstream of the bevel 28 on the internal face of one respectively of two diametrally opposed parts of the lateral wall of the downstream skirt part 26**.

Thus, each of the jets J1 and J2 breaks up on the lateral wall of the skirt 25, and the fuel of this jet is then dispersed and diffused by the bevel 28 and its trailing edge in the form of a thinned blade 29 into one respectively of the air ports, in which a good air/fuel mixture is formed by virtue of the presence of this bevel 28 and of its trailing edge in the form of a thinned blade 29.

The thinned blade 29 of the skirt 25 brings the post-diffusion which it provides close to the corresponding inlet valves, with respect to the tip 2 of the injector where the two jets J1 and J2 of fuel come out. In addition, these jets are angularly recentered by their striking parts of the lateral wall of the skirt at 30. This results in a certain degree of compensation for an excessively great distance separating the injector tip 2 from the corresponding inlet valve or valves, and therefore in a minimal formation of liquid films of fuel on the wall of the intake ports, and a greater insensitivity to a variation in the angle of separation between the jets J1 and J2.

Figure 3:
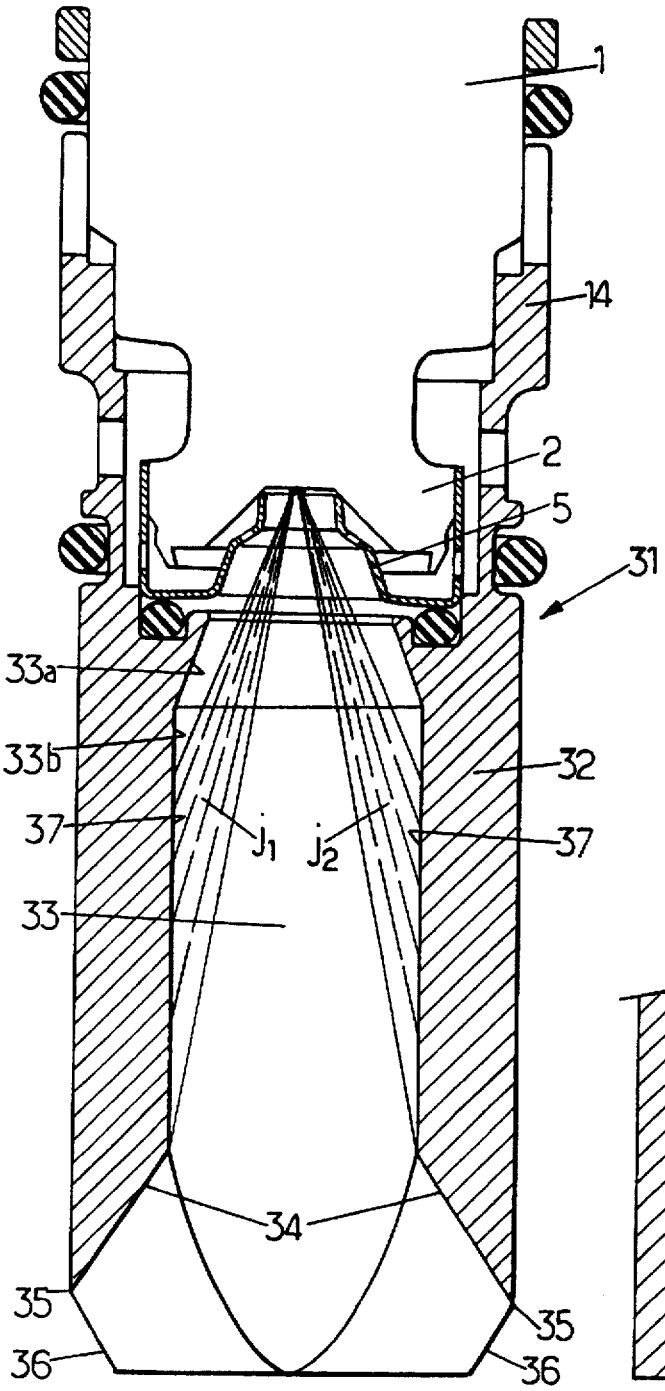
FIG. 3 is a view similar to FIG. 2 of a similar injector with a long skirt with whistle-type notches.
Figure 4:
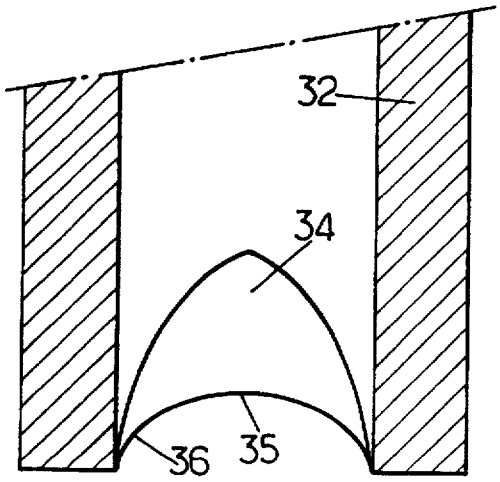
FIG. 4 is a part section of the downstream part of the skirt of the injector of FIG. 3 through a plane orthogonal to the plane of this figure.

FIGS. 3 and 4 represent a variation of an injector with a long skirt forming a post-diffuser which can be distinguished essentially from the one of FIG. 2 only in the shape of the central bore of the downstream part of the skirt and the structure of the opposed parts of its lateral wall forming the bevels.

What we have here is a skirt 31 including a downstream part 32, the central bore 33 of which is formed of a frustoconical upstream portion **33*a* diverging toward the downstream end, and of limited axial dimension, and a downstream portion 33*b* which is cylindrical, preferably of circular section, and extends over the remainder of the length of the downstream part of the skirt 32. Bevels 34 of thickness decreasing from upstream to downstream as far as a downstream free edge or trailing edge 35 in the form of a thinned blade are formed in the downstream end part of the bore 33 by cylindrical machinings of axes inclined with respect to one another and with respect to the longitudinal axis of the skirt 31, and which converge toward the inside of the skirt 31, the machinings being made in the internal face of the two diametrally opposed halves of the bottom of the skirt 31. Thus, each free downstream edge 35 in the form of a thinned blade of a bevel 34 has a concave notch 36, with concavity turned toward the downstream end, and substantially symmetric, like each bevel 34, with respect to the diametral mid-plane of the bore 33 corresponding to the plane of FIG. 3, that is to say to the plane containing substantially the axes of the jets J1 and J2** of fuel and the longitudinal axis of the injector.

The outlet orifice formed by the skirt 31 for each of the jets J1 and J2 of fuel, is thus delimited between the two opposed lateral walls each formed by one of the two bevels 34 which diverge toward the downstream end with respect to one another and with respect to the axis of the bore 33, thus delimiting between them a passage which diverges toward the downstream end.

In addition, each of the two divergent jets J1 and J2 of fuel hits a striking region 37 situated upstream of a corresponding bevel 34, on respectively one of two diametrally opposed parts of the internal face of the lateral wall of the skirt, in the cylindrical part 33*b* of its central bore 33. After striking at 37, each jet of fuel is then dispersed and diffused into one of the two corresponding air ports, in which an excellent air/fuel mixture is obtained by virtue of the whistle shape given to the outlet orifice of the skirt for each jet of fuel by the interaction between a bevel 34, its trailing edge 35 in the form of a thinned blade, and its concave notch 36. In particular, the concave notch 36 improves atomization of fuel by tearing away the liquid films of fuel running down the internal face of the lateral walls of the skirt, downstream of the striking regions 37.

As a variation, the bevels may be produced on the external face of the downstream end part of the skirt, as represented in FIGS. 5 to 8.

Figure 5:
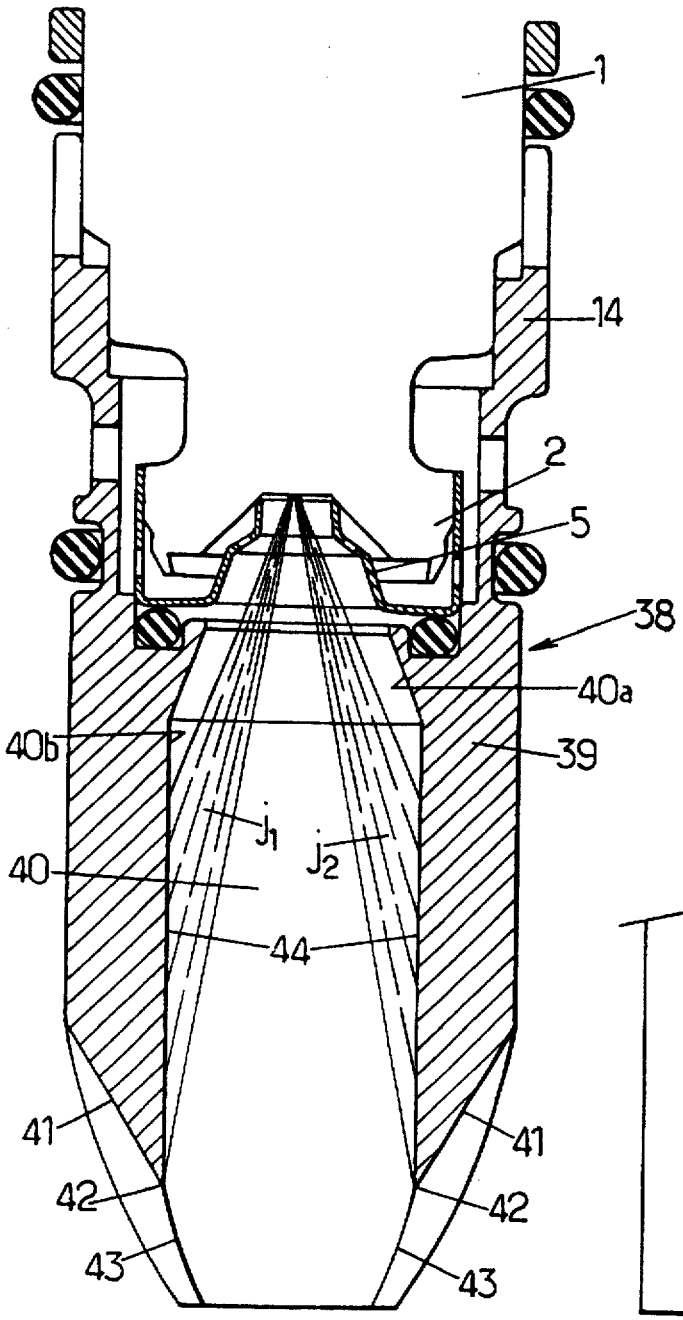
FIG. 5 is another view similar to FIG. 2 of an injector with a long skirt notched like a whistle into bevels on the external face of the bottom of the skirt.
Figure 6:
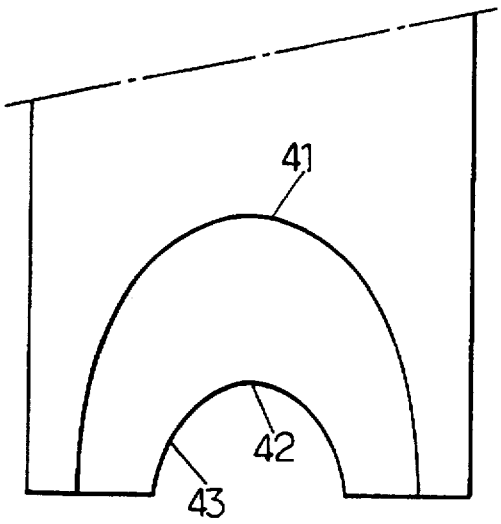
FIG. 6 is a part view in side elevation of the bottom of the skirt of the injector of FIG. 5.

In the variation of FIGS. 5 and 6, the skirt 38 has its downstream part 39, the central bore 40 of which comprises a frustoconical upstream portion 40*a* diverging toward the downstream end and a downstream portion 40*b* which follows on from it, and which is cylindrical and preferably of circular section as far as the downstream end of the skirt 51. Two bevels 41 are formed, each by one respectively of two cylindrical machinings of axes inclined with respect to one another and symmetrically inclined with respect to the longitudinal axis of the skirt 38, and concurrent with the latter axis at the downstream part of the skirt 38. Each bevel 41 is formed in the external face of one respectively of the two diametrally opposed parts of the cylindrical wall of the downstream end part of the skirt 38, against the internal face of which the jets J1 and J2 break up in the striking regions 44. The bevels 41 are formed so that each one of them ends in a trailing edge in the form of a thinned blade 42 exhibiting a concave notch 43 with concavity turned toward the downstream end, which improves the diffusion, into a corresponding air port, of the fuel originating from the jet post-atomized on the trailing edge 42 and the corresponding notch 43.

Figure 7:
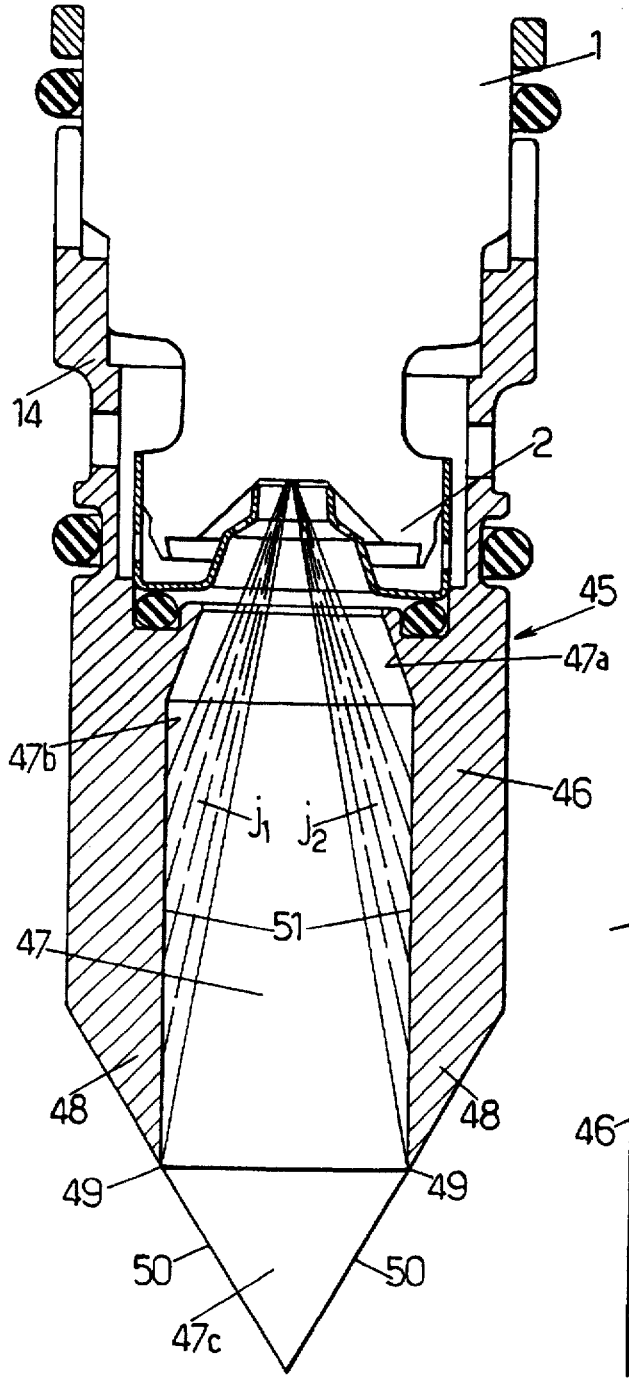
FIG. 7 is yet another view similar to FIG. 2 for a variation on the injector with skirt notched like a whistle of FIG. 5.
Figure 8:
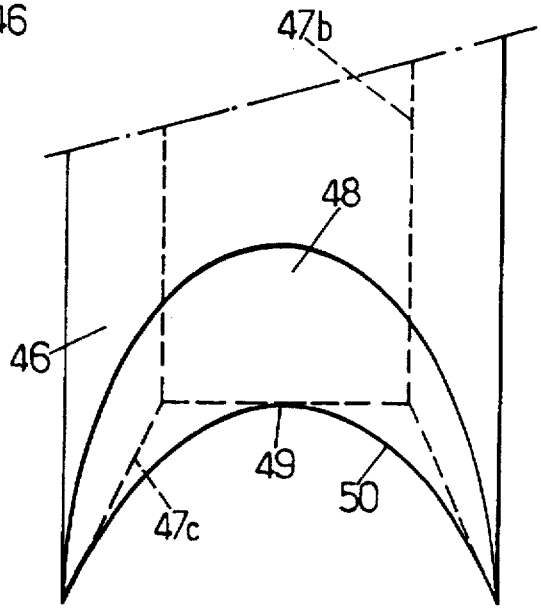
FIG. 8 is a view similar to FIG. 6 for the variation of FIG. 7.

Finally, in the variation of FIGS. 7 and 8, the central bore 47 of the downstream part 46 of the skirt 45 exhibits a frustoconical downstream end portion 47*c* diverging toward the downstream end, which follows on from the cylindrical intermediate portion 47*b*, itself following on from the frustoconical upstream portion 47*a* diverging toward the downstream end. The two bevels 48 with trailing edge in the form of a thinned blade 49 exhibiting a concave notch 50 are preferably formed by two machinings in the external face of the opposed halves of the wall of the downstream part 46 of the skirt, even with not only the entire divergent downstream portion 47*c* of the internal bore, but also with an adjacent part of the cylindrical bore portion 47*b*. In this variation, the bevels 48 meet substantially even with two diametrally opposed points, projecting toward the downstream end, and obtained by the cylindrical machinings of axes which are inclined with respect to one another and inclined symmetrically with respect to the longitudinal axis of the skirt 45, owing to their intersections with the divergent frustoconical bore portion 47*c* in the wall of the downstream skirt part 46. In this variation too, each trailing edge in the form of a thinned blade 49 with its notch 50 is formed in the skirt on a side of the wall directly downstream from one of the two striking regions 51 for the two jets J1 and J2 of fuel.

This variation, like those of FIGS. 3 to 6, promotes the transfer of the fuel from the jets J1 and J2 to the two corresponding air ports, in conditions liable to guarantee good preparation of the air/fuel mixture as far as the entry to the combustion chamber.

What is claimed is:

1. A fuel injector for supplying an internal combustion engine, said internal combustion engine comprising at least two inlet valves for injecting fuel selectively into at least one air intake port of a combustion chamber of said internal combustion engine, said injector comprising: a body equipped with an injector tip comprising at least one calibrated outlet hole for at least one jet of fuel oriented substantially toward a corresponding at least one air intake port of a combustion chamber of an engine; a skirt for dispersing and transferring fuel, which it receives from said at least one calibrated outlet hole, into said at least one air port, said skirt comprising a tubular overall structure extending substantially over the body, said tubular overall structure comprising an upstream part secured to the body and surrounding the injector tip and the at least one calibrated outlet hole, and a downstream part defining at least one outlet orifice having a diameter through which at least one fuel passage formed in the skin projects into the at least one air port, said skirt comprising a downstream part comprising at least one lateral wall comprising a bevel having a thickness decreasing from upstream to downstream terminating in a downstream free edge as a thinned blade and an outer face which is substantially devoid of surface irregularities upstream from said downstream free edge for a distance greater than a distance corresponding to the diameter of said outlet orifice, and wherein said skirt allows films of fuel to be tow away from the edge of the bevel by energy of the air flow in the intake port adjacent the downstream end of the skirt.

2. The injector according to claim 1, comprising a central bore defined by said lateral wall of said skirt for receiving at least one jet of fuel injected through said at least one calibrated hole, said central bore diverging towards said downstream fuel edge of said skirt.

3. The injector according to claim 1, comprising a cylindro-conical central bore defined by said lateral wall of said skirt for receiving at least one jet of fuel injected through said at least one calibrated hole, said cylindro-conical central bore comprising a divergent portion at a downstream end of said skirt.

4. The injector according to claim 1, wherein said downstream free edge of said skirt comprises a concave notch, having concavity facing downstream, formed in the downstream free edge in the form of a thinned blade of said bevel.

5. The injector according to claim 1, wherein said bevel comprises an internal face of said downstream part of said skirt.

6. The injector according to claim 1, wherein said bevel comprises an external face of said downstream part of said skirt.

7. The injector according to claim 1, wherein at least one lateral wall of said skirt comprises an internal face comprising a region for being struck by at least one jet of fuel leaving said at least one calibrated hole.

8. The injector according to claim 1, wherein said skirt comprises a cylindrical external overall shape, having an axisymmetric central bore.

9. The injector according to claim 1, wherein at least said downstream part of said skirt comprises a central bore defined by an annular bevel.

10. The injector according to claim 1 comprising a pneumatic atomization cap, arranged in said skirt substantially even with said injector tip for delimiting around said at least one jet of fuel leaving said at least one calibrated hole and a substantially annular duct for air for assisting with atomization substantially at atmospheric pressure, said pneumatic atomization cap comprising a plurality of air-passage orifices for the passage of air from said annular duct toward said at least one jet of fuel, said air-passage orifices having axes substantially transverse to said at least one jet of fuel and being distributed over said pneumatic atomization cap so that, for low pressure gradients at the air-passage orifices, at high engine loads, said at least one jet of fuel leaving said at least one calibrated hole is diffused by said skirt toward a respective one of said at least one air intake port, whereas, for high pressure gradients, at low idle and low and medium engine loads, a jet of fuel leaving said at least one said calibrated hole is deflected by air passing through said air passage orifices of said pneumatic atomization cap toward another jet of fuel with which it mixes into a single mist of fuel atomized pneumatically in said skirt.

11. A fuel injector for supplying an internal combustion engine, said internal combustion engine comprising at least two inlet valves for injecting fuel selectively into at least one air intake port of a combustion chamber of said internal combustion engine, said injector comprising: a body equipped with an injector tip comprising at least one calibrated outlet hole for at least one jet of fuel oriented substantially toward a corresponding at least one air intake port of a combustion chamber of an engine; a skirt for dispersing and transferring fuel, which it receives from said at least one calibrated outlet hole, into said at least one air port, said skirt comprising a tubular overall structure extending substantially over the body, said tubular overall structure comprising an upstream part secured to the body and surrounding the injector tip and the at least one calibrated outlet hole, and a downstream part defining at least one outlet orifice through which at least one fuel passage formed in the skirt projects into the at least one air port, said skirt comprising a downstream part comprising at least one lateral wall comprising a bevel having a thickness decreasing from upstream to downstream terminating in a downstream free edge and comprising a concave notch having concavity facing downstream formed in said downstream free edge in the form of a thinned blade, wherein said skirt allows films of fuel to be tow away from the edge of the bevel by energy of the air flow in the intake port adjacent the downstream end of the skirt.

12. The injector according to claim 11, comprising a central bore defined by said lateral wall of said skirt for receiving at least one jet of fuel injected through said at least one calibrated hole, said central bore diverging towards said downstream fuel edge of said skirt.

13. The injector according to claim 11, comprising a cylindro-conical central bore defined by said lateral wall of said skirt for receiving at least one jet of fuel injected through said at least one calibrated hole, said cylindro-conical central bore comprising a divergent portion at a downstream end of said skirt.

14. The injector according to claim 11, wherein said bevel comprises an internal face of said downstream part of said skirt.

15. The injector according to claim 11, wherein said bevel comprises an external face of said downstream part of said skirt.

16. The injector according to claim 11, wherein at least one lateral wall of said skirt comprises an internal face comprising a region for being struck by at least one jet of fuel leaving said at least one calibrated hole.

17. The injector according to claim 11, wherein said skirt comprises a cylindrical external overall shape having an axisymmetric central bore.

18. The injector according to claim 11, wherein at least said downstream part of said skirt comprises a central bore defined by an annular bevel.

19. The injector according to claim 11 comprising a pneumatic atomization cap, arranged in said skirt substantially even with said injector tip for delimiting around said at least one jet of fuel leaving said at least one calibrated hole and a substantially annular duct for air for assisting with atomization substantially at atmospheric pressure, said pneumatic atomization cap comprising a plurality of air-passage orifices for the passage of air from said annular duct toward said at least one jet of fuel, said air-passage orifices having axes substantially transverse to said at least one jet of fuel and being distributed over said pneumatic atomization cap so that, for low pressure gradients at the air-passage orifices, at high engine loads, said at least one jet of fuel leaving said at least one calibrated hole is diffused by said skirt toward a respective one of said at least one air intake port, whereas, for high pressure gradients, at low idle and low and medium engine loads, a jet of fuel leaving said at least one said calibrated hole is deflected by air passing through said air passage orifices of said pneumatic atomization cap toward another jet of fuel with which it mixes into a single mist of fuel atomized pneumatically in said skirt.

* * * * *

UNITED STATES PATENT AND TRADEMARK OFFICE

CERTIFICATE OF CORRECTION

PATENT NO. : 5,694,898

DATED : December 9, 1997

INVENTOR(S) : Michael Pontoppidan et al

It is certified that error appears in the above-identified patent and that said Letters Patent is hereby corrected as shown below:

On the title page, item [73], Assignee:
Magnetic Marelli France, Nantarre" should read --Assignee:
Magneti Marelli France, Nanterre--

Signed and Sealed this

Twenty-seventh Day of April, 1999

*Attest:*

Q. TODD DICKINSON

*Attesting Officer*

*Acting Commissioner of Patents and Trademarks*